US006085556A

United States Patent [19]

Moon

[11] Patent Number: 6,085,556

[45] Date of Patent: Jul. 11, 2000

[54] DISPENSER FOR WASHING MACHINE

[76] Inventor: Jong-Yeol Moon, Sankok-Dong, Pupyung-Ku, Incheon, Rep. of Korea

[21] Appl. No.: 09/219,720

[22] Filed: Dec. 23, 1998

[51] Int. Cl.[7] ..... D06F 29/00

[52] U.S. Cl. ..... 68/13 A; 68/17 R; 68/183; 68/207

[58] Field of Search ..... 422/186.07, 186.08, 422/186.12; 68/13 A, 183, 207, 17 R

[56] References Cited

U.S. PATENT DOCUMENTS

| | | | |
|---|---|---|---|
| 3,130,570 | 4/1964 | Rentzepis | 68/207 |
| 3,339,737 | 9/1967 | Ksicellus et al. | 68/13 A |
| 4,402,197 | 9/1983 | Groult et al. | 68/207 |
| 4,434,629 | 3/1984 | Bianchi et al. | 68/13 A |
| 4,481,086 | 11/1984 | Bianchi et al. | 68/207 |
| 4,666,679 | 5/1987 | Masuda et al. | 422/186.07 |
| 5,082,558 | 1/1992 | Burris | 422/186.08 |
| 5,207,993 | 5/1993 | Burris | 422/186.07 |
| 5,307,649 | 5/1994 | Lim et al. | 68/183 |
| 5,590,551 | 1/1997 | Hong | 68/183 |
| 5,653,129 | 8/1997 | Jang . | |
| 5,656,246 | 8/1997 | Patapoff et al. | 422/186.07 |
| 5,788,930 | 8/1998 | McMurray | 422/186.07 |

FOREIGN PATENT DOCUMENTS

| | | | |
|---|---|---|---|
| 208548 | 5/1957 | Australia | 68/183 |

OTHER PUBLICATIONS

European Patent Application 495,168, Jul. 1992.

*Primary Examiner*—Frankie L. Stinson

*Attorney, Agent, or Firm*—Jacobson, Price, Holman & Stern, PLLC

[57] ABSTRACT

A dispenser for a washing machine integrates a bubble generator, an ozone generator, and a radical generator. In the dispenser for a washing machine, a housing has a gas mixing chamber therein. A bubble generator is disposed in the housing and generates air for generating air bubbles and ozone and pumping to the gas mixing chamber. An ozone generator is disposed in the gas mixing chamber and applies high voltage to the air introduced in the gas mixing chamber from the bubble generator in order to produce ozone. A radical generator has a ceramic catalyst for decomposing the ozone from the ozone generator into an oxygen for generating air bubbles and a generating oxygen to be reactive with a hydrogen ion in washing water in order to generate a radical. The dispenser sterilizes bacilli such as bacteria, viruses, mold, fungi, or algae which live in washing water or clothes. The dispenser also improves washing effect of a washing machine by oxidizing and bleaching actions of ozone and radical.

3 Claims, 5 Drawing Sheets

DISPENSER FOR WASHING MACHINE

BACKGROUND OF THE INVENTION

1. Field of the Invention

The present invention relates to a washing machine, and more particularly, to a dispenser for a washing machine having a bubble generator, an ozone generator, and a radical generator formed integrally.

2. Prior Art

Most washing machines wash the laundry by using the mechanical force of a pulsator or drum and the surface active force of a chemical detergent. Accordingly, in order to improve the washing efficiency, many washing machine makers have utilized various methods including: improving the pulsator's ability to agitate the laundry, extending the operation time of the motor and/or the water flow time, and improving the quality and/or increasing the quantity of detergent used in the washing machine. However, there are limits to improve the washing efficiency by the aforementioned methods for the following reasons. The methods utilizing increased mechanical force to improve the washing efficiency may cause damage to the laundry or to decrease efficiency of the clothes washing machine.

In the methods utilizing increased amounts of detergent, a relatively large amount of the detergent which does not react with the laundry is then discharged where it can later cause environmental pollution, and also the remaining detergent sticks to the laundry and thus the laundry is not effectively cleaned.

U.S. Pat. No. 5,653,129, (issued to Byung-Kew Jang. on Aug. 5, 1997) discloses a bubble automatic washing machine which has a bubble generator and an ozone generator connected to each other in parallel.

FIG. 1 shows a conventional bubble automatic washing machine 100 with a bubble generator and an ozone generator connected to each other in parallel, described in the U.S. Pat. No. 5,653,129.

The washing machine 100 includes a housing 102 and a stationary washer tub 104 fixedly mounted within housing 102 for containing a level of washing fluid therein. Pulsator 106 is rotatable in a forward or reverse direction to create a vortex flow within rotatable tub 112.

The upside of washing machine 100 is provided with a door 108 for loading and unloading the laundry articles . Bubble feeding means 130 is mounted on the inner surface of door 108 to extend toward rotatable tub 112. Bubble generator 110 is shown in FIG. 2 in detail. An air pump 116 is communicated with bubble generator 110 through an air conduit 114. In the drawings, air pump 116 is installed at the bottom plate of washing machine 100 but may be installed at any other suitable place.

Bubble generator 110 includes a telescopic pipe 202 which is movable upward and downward, and driver 204 for actuating telescopic pipe 202. Though 3-stage telescopic pipe 202 is shown in the drawings, the number of stages is not especially limited as long as the washing machine operates smoothly.

Telescopic pipe 202 is fixed to a casing 218 of driver 204 coaxially with rotatable tub 124. Casing 218 is fixed to the inner surface of door 108 and a DC motor 206 is installed to casing 218. A driving shaft 208 of DC motor 206 is operatively connected to a first pulley 210 which is operatively connected to a second pulley 214 through a belt 212.

Second pulley 214 has a groove for belt 212 and gear teeth formed separately and a flexible plastic string 216 is wound on the gear teeth. A train of teeth are formed on flexible string 216 to mesh with the gear teeth. Flexible string 216 has a flexibility suitable for being forced to expand and withdraw telescopic pipe 202.

Flexible string 216 extends within, through a hole 219 formed to casing 218, an inner telescopic pipe 220 which is coaxially installed inside telescopic pipe 202 and has the top end fixed to casing 218. The end of flexible string 216 is fixed to the lower end of inner pipe 220 which is fixed to the lower end of telescopic pipe 202.

The lowest stage of telescopic pipe 202 is provided with a plurality of blow-out holes 222 to create air bubbles. Air conduit 114 extends through casing 218 and communicates with inside of telescopic pipe 202. A space between telescopic pipe 202 and inner pipe 220 serves as an air passage and the air flowing out of air conduit 114 blows into rotatable tub 112, sequentially passing through the space and blow-out holes 222.

An ozone generator 118 may be further installed between air pump 116 and driver 204 in order to kill bacteria inhabiting the laundry articles. As a result, ozone is contained in air bubbles blowing into rotatable tub 124 to remove bacteria from the laundry articles.

Moreover, a heater 120 may be installed between ozone generator 118 and driver 204 in order to create a hot air stream for drying the laundry articles. The air stream generated from air pump 116 flows through air conduit 114 to heater 120 to heat up and is transmitted to the laundry articles within rotatable tub 112.

SUMMARY OF THE INVENTION

Therefore, it is an object of the present invention, for the purpose of solving the above mentioned problems, to provide a dispenser for a washing machine which integrates a bubble generator, an ozone generator, and a radical generator.

In order to attain the object, according to the present invention, there is provided a dispenser for a washing machine, said dispenser comprising:

- a housing having a gas mixing chamber therein;
- a bubble generator disposed in the housing for generating air for generating air bubbles and ozone and pumping to the gas mixing chamber;
- an ozone generator disposed in the gas mixing chamber for applying high voltage to the air introduced in the gas mixing chamber from the bubble generator in order to produce ozone; and
- a radical generator disposed in the housing and communicated with the gas mixing chamber, the radical generator having a ceramic catalyst for decomposing the ozone from the ozone generator into an oxygen for generating air bubbles and a generating oxygen to be reactive with a hydrogen ion in washing water in order to generate a radical.

According to the present invention, the present invention sterilizes bacilli such as bacteria, viruses, mold, fungi, or algae which live in washing water or clothes. The present invention also improves washing effect of a washing machine by oxidizing and bleaching actions of ozone and radical.

Other objects and further features of the present invention will become apparent from the detailed description when read in conjunction with the attached drawings.

BRIEF DESCRIPTION OF THE DRAWINGS

Other features and advantages of the present invention will become more apparent from the following description taken in connection with the accompanying drawings, wherein.

DETAILED DESCRIPTION OF THE PREFERRED EMBODIMENT

The preferred embodiment of the present invention will hereinafter be described in detail with reference to the accompanying drawings.

Figure 1:
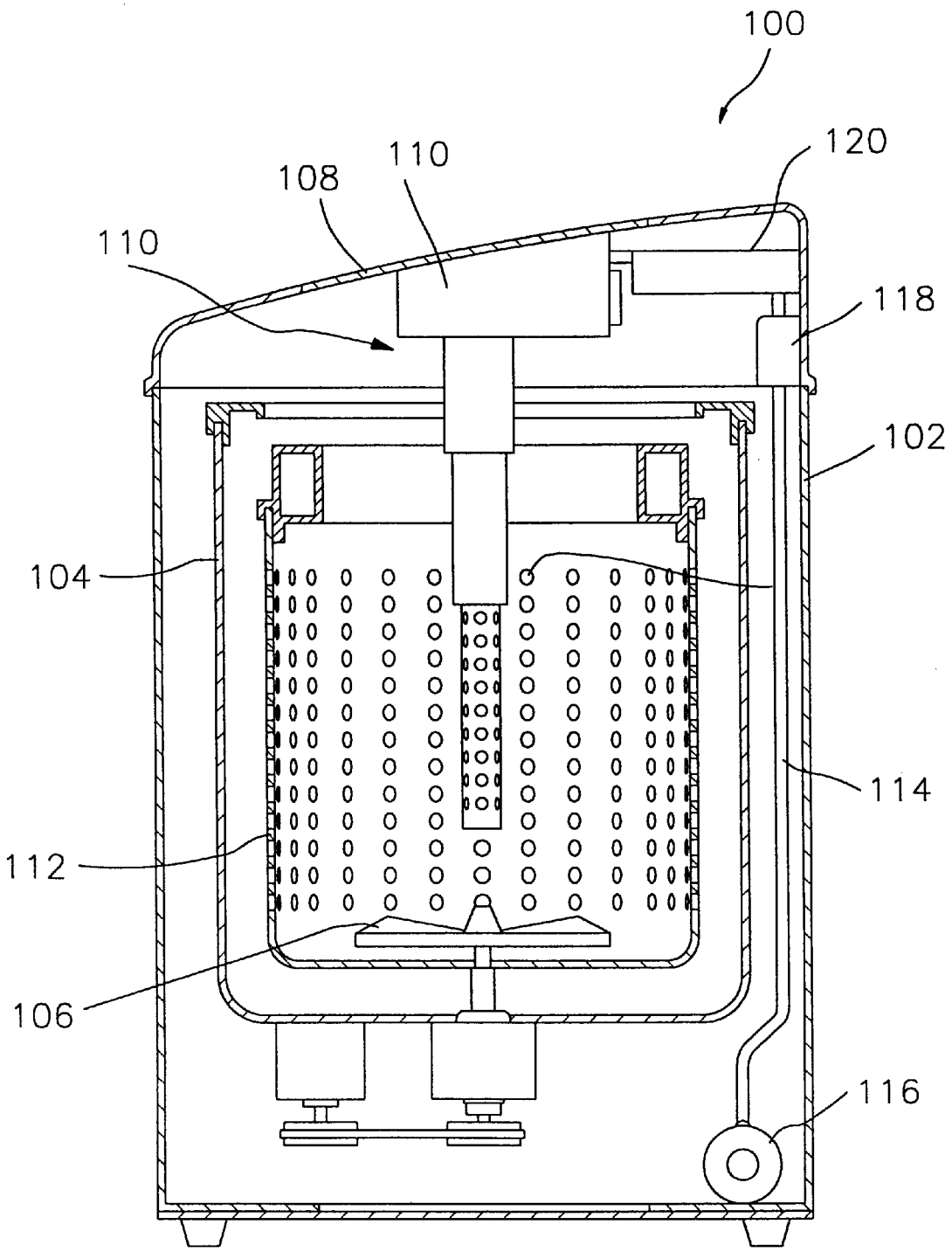
FIG. 1 PRIOR ART
FIG. 1 is a schematic sectional view for showing a conventional bubble washing machine having bubble and ozone generators connected to each other in parallel.
Figure 2:
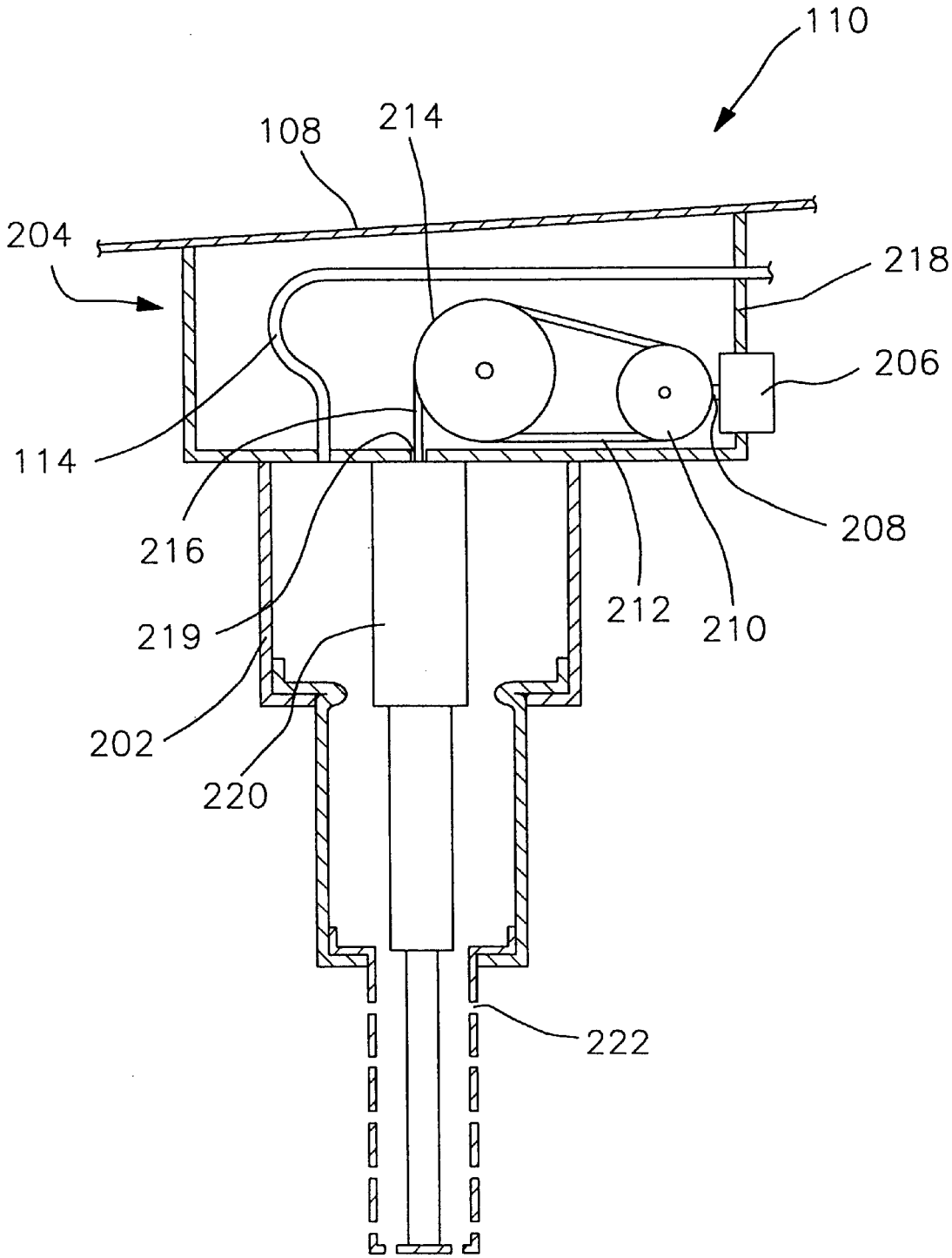
FIG.2 PRIOR ART
FIG. 2 is an enlarged sectional view of the bubble generator shown in FIG. 1.
Figure 3:
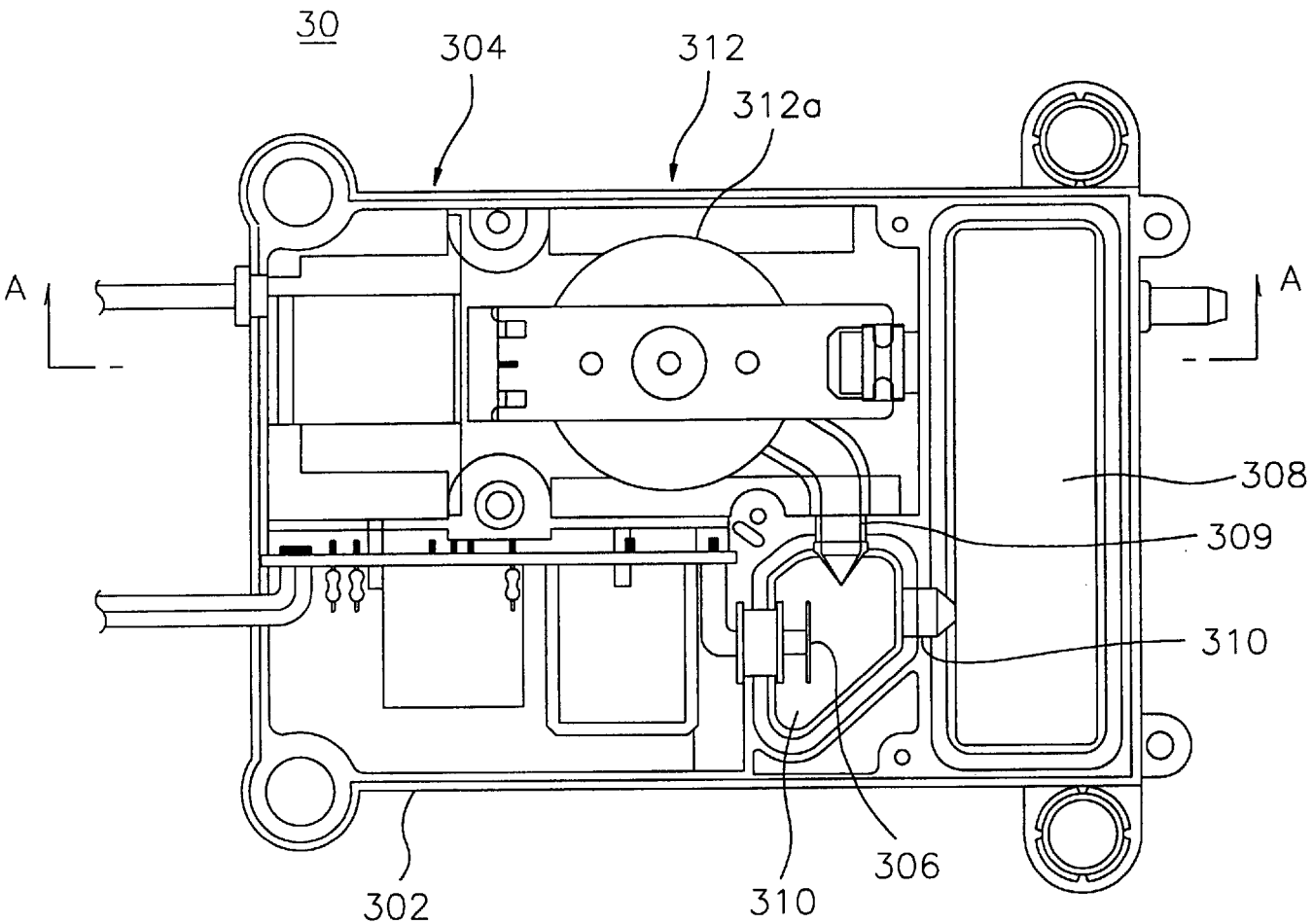
FIG. 3 is a plan view for showing a dispenser for a washing machine according to a preferred embodiment of the present invention.

FIG. 3 shows a dispenser 30 for a washing machine according to a preferred embodiment of the present invention.

The dispenser 30 for a washing machine includes a housing 302, a bubble generator 304, an ozone generator 306, a radical generator, a first check valve 309, and a second check valve 310.

The housing 302 has a gas mixing chamber 302*a* therein.

The bubble generator 304 is disposed in the housing 302. The bubble generator 304 generates air for generating air bubbles and ozone and pumps them to the gas mixing chamber 302*a* of the housing 302.

Figure 4:
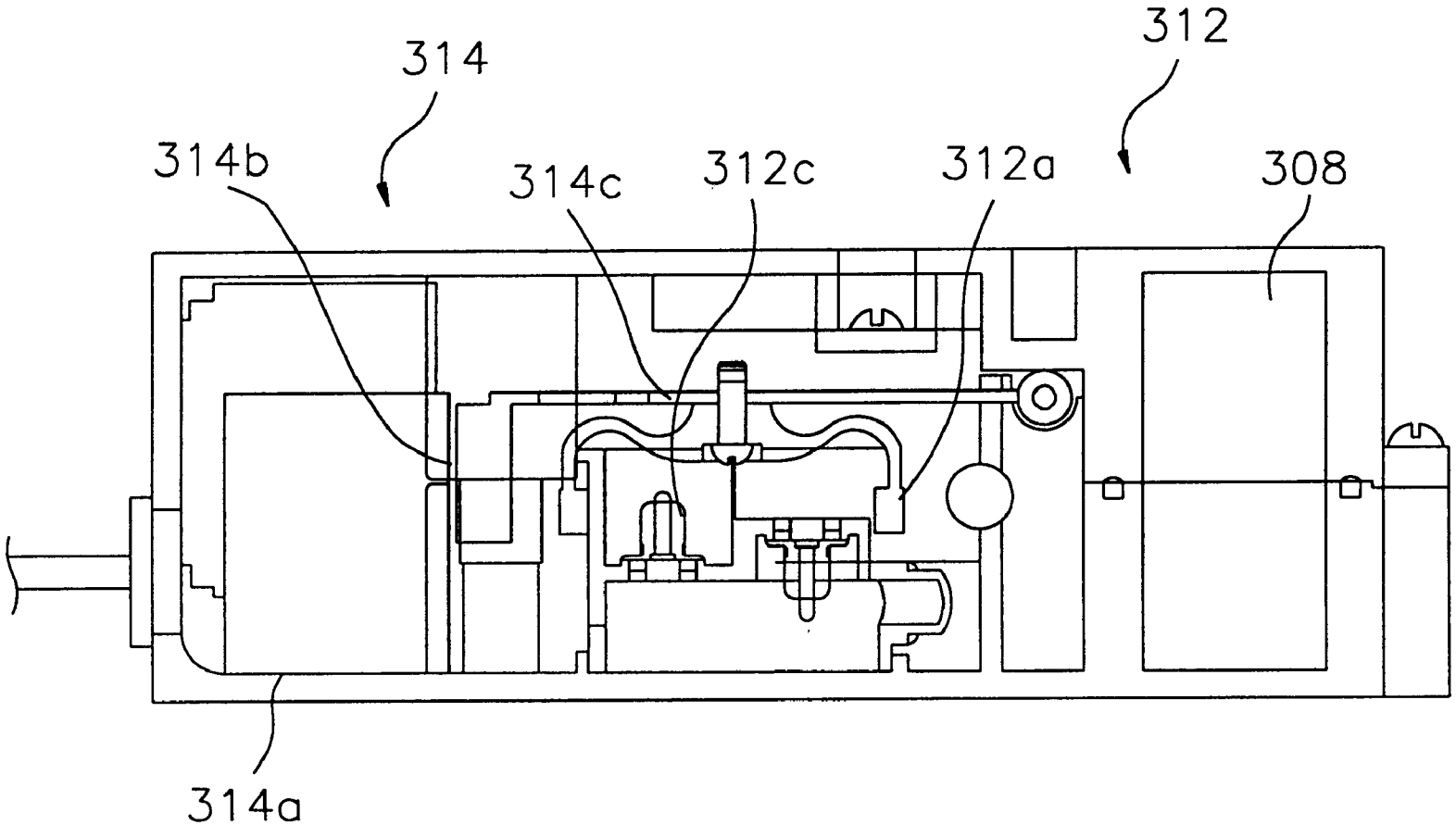
FIG. 4 is a side end view of the bubble generator taken along line A—A shown in FIG. 3.
Figure 5:
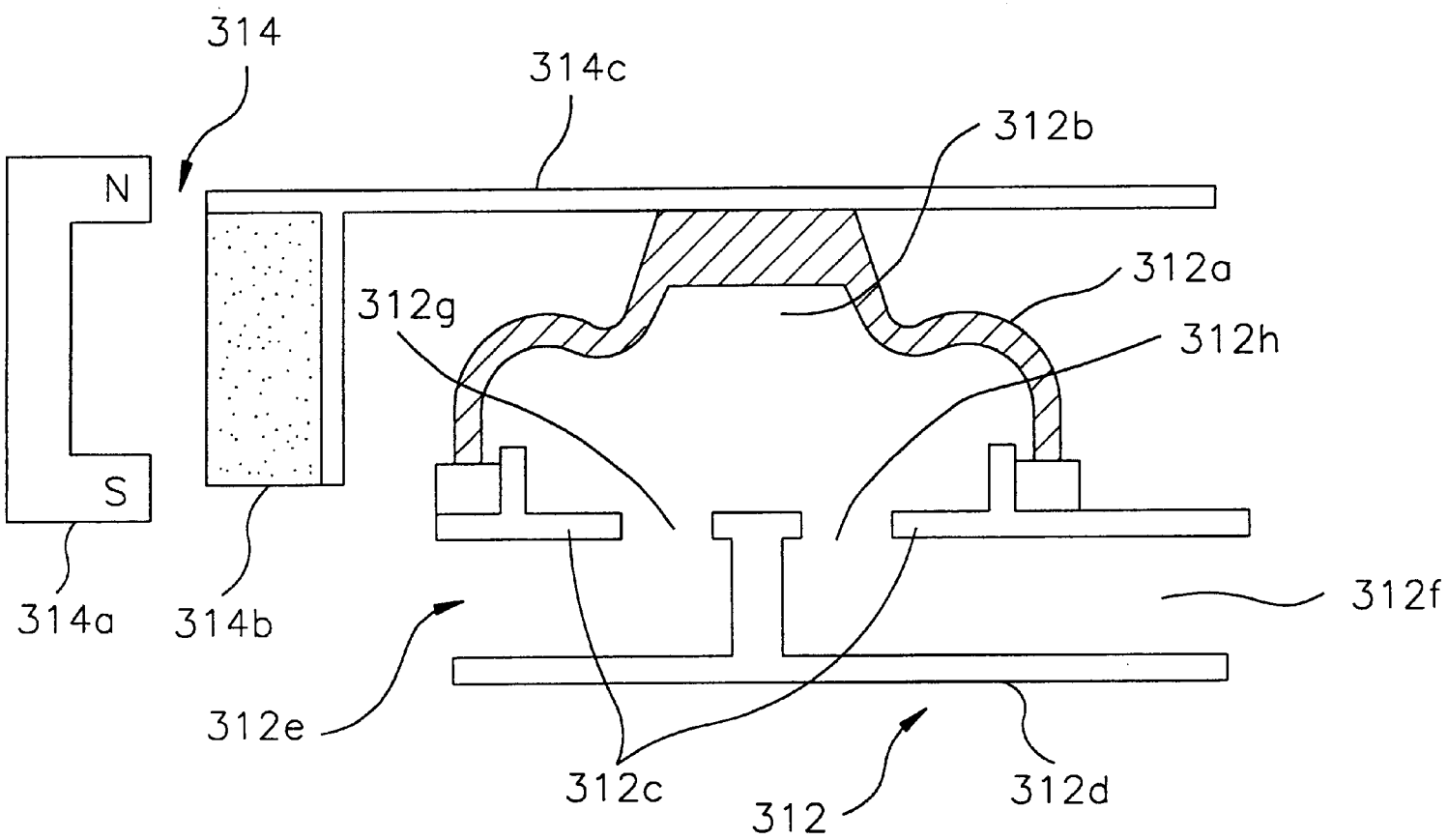
FIG. 5 is a view for illustrating a principle of an operation of the bubble generator shown in FIGS. 3 and 4.

FIG. 4 is a side end view of the bubble generator 304 taken along line A—A shown in FIG. 3. FIG. 5 illustrates a principle of an operation of the bubble generator 304 shown in FIGS. 3 and 4.

The bubble generator 304 includes an air pump 312 and an operating section 314. The air pump 312 pumps the air for generating air bubbles and ozone to the gas mixing chamber 302*a*.

The air pump 312 includes a diaphragm 312*a* fixed to the operating section 314. The diaphragm 312*a* expands by means of up and down motion of the operating section 314 and expands and contracts volume of a pump chamber 312*b* formed therein. The diaphragm 312*a* is formed from a resilient material such as rubber capable of contracting or expanding by an external force. An air pump body 312*d* is installed apart from valve sheet 312*c* at a predetermined distance. The air pump body 312*d* includes an air inlet 312*e* for introducing external air to the pump chamber 312*b* by compression and contraction of the diaphragm 312*a*. The air pump body 312*d* includes an air outlet 312*f* for discharging the air in the pump chamber 312*b* to the gas mixing chamber 302*b*. The air introduced through the air inlet 312*a* is guided into the pump chamber 312*b* which is defined by the diaphragm 312*a* and the air pump body 312*d* through a first hole 312*g*. The air compressed in the pump chamber 312*b* is discharged to the air outlet 312*f* through a second hole 312*h*.

The operating section 314 compresses and returns the air pump 312 according to current supply. The operating section 314 includes an electromagnet 314*a*, a magnet 314*b*, and an operating member 314*c*. The electromagnet 314*a* generates magnetic field according to current supply. The magnet 314*b* vibrates according to the magnetic field generated by the electromagnet 314*a*. The operating member 314*c* moves up and down according to the vibration of the magnet 314*b*.

As shown in FIG. 5, the bubble generator 302 uses a principle of the electromagnet 314*a*. When 200 V/60 Hz power is applied to a coil-wound core, a phase of the electromagnet 314*a* changes thereby changing polarity of the magnetic field generated around surface of the core. Accordingly, the phenomenon which pushes and pulls the magnet 314*b* repeats and oscillates sixty times per second. The magnet 314*b* which oscillates at 10 Hz compresses and returns the air pump 312 so that the pumping operation is performed through the diaphragm 312*a*.

The ozone generator 306 is disposed in the gas mixing chamber 302*a*. The ozone generator 306 applies high voltage to the air for generating air bubbles and ozone introduced in the gas mixing chamber 302*a* from the bubble generator 304 in order to produce ozone. Ozone($O_3$) is a triatomic allotrope of oxygen in which the ozone molecule consists of three oxygen atoms in contrast to the two oxygen atoms which have the typical oxygen molecule($O_2$). Ozone can be generated by passing air or oxygen through a high intensity electric field. Some of the oxygen molecules will be energized and will split into two separate atoms. These individual oxygen atoms will then form weak bonds with other oxygen molecules. The ozone molecule is oxygen in a highly reactive form. It has a tendency to give up its extra oxygen atom and gain electrons. This molecular structure gives ozone its high oxidizing power which allows ozone to react rapidly with a large variety of compounds. Ozone has been used in the treatment of drinking water and has gained widespread use in the water treatment industry largely from the fact that it is the second most powerful oxidant known. This fact results in three distinct uses of ozone: the control of pollutants as a sterilant for microorganisms and in deodorization. Ozone has also been used in the laundry industry. Ozone is in a highly reactive gaseous form in laundry processing, allowing it to react with and remove soil at a greatly increased rate which accounts for a substantial reduction in processing time. For these reasons, excellent results can be achieved using ozone and only about half the amount of surfactants usually required.

The radical generator 308 is disposed in the housing 302 and communicates with the gas mixing chamber 302*a*. The radical generator 308 has a ceramic catalyst for decomposing the ozone from the ozone generator into an oxygen for generating air bubbles and a an oxygen ion to be reactive with a hydrogen ion in washing water in order to generate a radical. The generating oxygen produced by the radical generator 308 reacts with $H^+$ ion to produce OH* radical. Reactivity of OH* radical is higher than that of ozone. The oxidizing power is longest to weakest in an order of F>R (OH*)>$O_3$>$H_2O_2$>. . . >$Cl_2$. Since the OH* radical has a second longest oxidizing power, it reacts with pollutants in washing water and improves washing effect by its oxidizing and bleaching actions. The powerful oxidizing action of the OH* radical effectively sterilizes bacilli such as bacteria, viruses, mold, fungi, or algae which live in washing water or clothes.

The first check valve 309 is mounted between the bubble generator 304 and the gas mixing chamber 302*a*. The first check valve 309 selectively introduces the air for generating air bubbles and ozone from the bubble generator 304 to the ozone generator 306. The first check valve 308 serves to prevent the supply air for generating air bubbles and ozone from the bubble generator 304 from flowing inversely.

The second check valve 310 is mounted between the gas mixing chamber 302*a* and the radical generator 308. The second check valve 310 selectively introduces the air for generating air bubbles and ozone from the ozone generator 306 to the radical generator 308. The check valve 308 serves to prevent the supply air for generating air bubbles and ozone from the ozone generator 308 from flowing inversely.

Hereinafter, an operation of the dispenser 30 for a washing machine according to a preferred embodiment of the present invention will be described.

When current is applied to the electromagnet 314*a* of operating section 314 of the bubble generator 304, the electromagnet 314*a* generates a magnetic field. The magnet 314*b* vibrates according to the magnetic field generated by the electromagnet 314*a*. The operating member 314*c* moves up and down according to the vibration of the magnet 314*b*.

The diaphragm 312*a* of air pump 312 expands by means of up and down motion of the operating member 314*c* and expands and contracts volume of a pump chamber 312*b* formed therein to thereby pump the air for generating air bubbles and ozone.

The first check valve 309 injects the air for generating air bubbles and ozone from the bubble generator 304 to the gas mixing chamber 302*a* so that the gas mixing chamber 302*a* stores the air for generating air bubbles and ozone. The ozone generator 306 applies high voltage to the air for generating air bubbles and ozone stored in the gas mixing chamber 302*a* in order to produce ozone.

The second check valve 310 injects the air for generating air bubbles and ozone from the ozone generator 306 to the radical generator 308 to the radical generator 308.

The radical generator 308 decomposes the ozone from the ozone generator 306 into an oxygen for generating air bubbles and a an oxygen ion to be reactive with a hydrogen ion in washing water by a ceramic catalyst which is included in the radical generator 308 in order to generate a radical. Accordingly, air bubbles, ozone, and a radical are generated in the washing water.

As mentioned above, the present invention sterilizes bacilli such as bacteria, viruses, mold, fungi, or algae which live in washing water or clothes. The present invention also improves washing effect of a washing machine by oxidizing and bleaching actions of ozone and radical.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A dispenser for a washing machine, said dispenser comprising:

a housing having a gas mixing chamber therein;

a bubble generator disposed in the housing for generating air for generating air bubbles and ozone and pumping to the gas mixing chamber;

an ozone generator disposed in the gas mixing chamber for applying high voltage to the air introduced in the gas mixing chamber from the bubble generator in order to produce ozone; and a radical generator disposed in the housing and communicated with the gas mixing chamber, the radical generator having a ceramic catalyst for decomposing the ozone from the ozone generator into an oxygen for generating air bubbles and an oxygen to be reactive with a hydrogen ion in washing water in order to generate a radical.

2. The dispenser as set forth in claim 1, further comprising a first check valve connected between the bubble generator and gas mixing chamber for selectively introducing the air for generating air bubbles from the bubble generator and ozone to the gas mixing chamber.

3. The dispenser as set forth in claim 1, further comprising a second check valve connected between the gas mixing chamber and radical generator for selectively introducing the ozone from the ozone generator to the radical generator.

* * * * *